US005085116A

United States Patent [19]

Nakata et al.

[11] Patent Number: 5,085,116

[45] Date of Patent: Feb. 4, 1992

[54] AUTOMATIC PERFORMANCE APPARATUS

[75] Inventors: Takuya Nakata; Hitoshi Makita; Takashi Hirakata; Shingo Kawasaki, all of Hamamatsu, Japan

[73] Assignee: Yamaha Corporation, Hamamatsu, Japan

[21] Appl. No.: 366,583

[22] Filed: Jun. 15, 1989

[30] Foreign Application Priority Data

Jun. 23, 1988 [JP] Japan ..... 63-153372

[51] Int. Cl.[5] ..... G10G 1/00; G10G 3/04

[52] U.S. Cl. ..... 84/609; 84/462; 84/477 R

[58] Field of Search ..... 84/609, 645, 649, 462, 84/463, 477 R

[56] References Cited

U.S. PATENT DOCUMENTS

| | | | |
|---|---|---|---|
| 4,646,609 | 3/1987 | Teruo et al. | 84/1.01 |
| 4,696,216 | 9/1987 | Asahi et al. | 84/609 |
| 4,881,440 | 11/1989 | Kakizaki | 84/649 |
| 4,885,969 | 12/1989 | Chesters | 84/477 R |

*Primary Examiner*—W. B. Perkey

*Attorney, Agent, or Firm*—Spensley Horn Jubas & Lubitz

[57] ABSTRACT

An automatic performance apparatus for recording performance data in a memory for controlling generation of musical tones, wherein the change or changes of pitch, key-on timing, key-off timing, note interval and/or note length data of a note can easily be effected. The note to be change is designated by positioning a cursor and operating a designation switch. The change of data of the note is achieved in accordance with the moving direction and amount of the cursor, for example, after the designation of the note.

7 Claims, 6 Drawing Sheets

AUTOMATIC PERFORMANCE APPARATUS

BACKGROUND OF THE INVENTION

1. Field of the Invention

The present invention relates to an automatic performance apparatus for recording performance data for controlling generation of musical tones in a memory in an electronic musical instrument or the like and sequentially reading out and performing the recorded performance data along with a progress of a music piece and, more particularly, to an automatic performance apparatus having an editor function capable of facilitating editing of performance data.

2. Description of the Prior Art

Various conventional automatic performance apparatuses for recording performance data in a memory, reading out the performance data from the memory and reproducing the data, and appropriately editing (changing) the recorded performance data are known (an automatic performance apparatus disclosed in Japanese Patent Laid-Open (Kokai) Sho No. 54-56414, "Performer" available from Unicorn Corp., and the like). However, in these apparatuses, a pitch and a key-on/key-off timing are changed by mainly changing numerical values, and a degree of change cannot be easily grasped.

In some known apparatuses, performance data is displayed on a CRT or an LCD display in the form of a musical score, and a note to be changed or the like is designated by a cursor (Japanese Patent Laid-Open (Kokai) Sho No. 57-86894); each note is displayed as a bar having a length corresponding to a note length ("Total Music" available from Southworth Music System Corp.); the cursor is moved using a so-called mouse (Japanese Utility Model Laid-Open (Kokai) Sho No. 61-49396); etc.

However, in these apparatuses, before or after a note is designated by the cursor, another operation is required to designate a parameter of the note to be changed (pitch, note length, key-on timing, or the like) and the way of changing the parameter, resulting in a cumbersome operation.

SUMMARY OF THE INVENTION

It is an object of the present invention to provide an automatic performance apparatus which can facilitate an edit operation, and allows easy grasping of a changed parameter of a note and a degree of change of the parameter.

As shown in FIG. 1, an automatic performance apparatus according to the present invention comprises: a memory 1 for storing a plurality of performance data for controlling generation of musical tones along with a progress of a music piece; read/write control means 2 for storing input data in the memory 1 and reading out and outputting the performance data stored in the memory 1; display means 3 for displaying a staff, a cursor, and a note whose shape changes in correspondence with a note length designated by the input data; cursor position control means 4; a designation switch 5 for designating one of notes displayed by the display means 3 in correspondence with a cursor position; and data calculating means 6 for calculating pitch, key-on timing, key-off timing, note interval and/or note length data associated with a note designated by the cursor and the switch 5 on the basis of the performance data read out from the memory 1 and a moving direction and amount of the cursor and supplying the calculated data to the read/write control means 2 and the display means 3.

When a note in recorded performance data is changed, an operator operates the cursor position control means 4 to adjust a cursor position to a note to be changed, designates using the designation switch that this note is to be changed, and thereafter, further moves the cursor. The data calculating means 6 sequentially calculates pitch, key-on timing, key-off timing, note interval and/or note length data associated with the designated note and notes immediately before and after the designated note as needed to follow the movement of the cursor after the note is designated, and supplies the calculated data to the read/write control means 2 and the display means 3. Thus, the display means 3 performs a display according to the sequentially supplied data. As a result, a note whose position and/or shape is changed in real time is displayed on the display means 3 in accordance with the movement of the cursor. On the other hand, when the read/write control means 2 receives data from the data calculating means 6, it rewrites the corresponding performance data in the memory 1 with data supplied from the data calculating means 6 sequentially or when the note designation is canceled.

More specifically, the display means 3 displays a bar having a length according to a note length of a note as a note corresponding to performance data at a corresponding pitch position on a staff, and the data calculating means calculates new data in accordance with the cursor position with respect to the note when the bar representing a note to be changed is designated by the designation switch 5 and with the moving direction and amount of the cursor after the note is designated. For example, when the cursor is located at a front portion of a bar to designate a note and is then moved forward, a key-on timing is advanced and a note length is prolonged by the moving amount of the cursor. When the cursor is moved backward, the key-on timing is delayed and the note length is shortened by the moving amount of the cursor. When the cursor position upon note designation corresponds to a rear portion of the bar, a key-off timing is shifted in a moving direction of the cursor, and the note length is changed according to the moving direction. Furthermore, when the cursor position upon note designation corresponds to a central portion of the bar, the bar representing the designated note is moved parallel in the vertical or horizontal direction in accordance with the movement of the cursor while its note length is left unchanged.

As described above, according to the present invention, since a note and its change content are designated by the cursor, an edit operation of performance data can be greatly facilitated as compared to a conventional editor.

Since a changed result is immediately displayed, a changed parameter of a note and its degree of change can be easily grasped.

Furthermore, as described above, since a parameter to be changed can be designated in accordance with a portion of a bar representing a note designated by the cursor, an operator can keep his or her eyes on a note, and a change content need not be designated in advance or another operation according to the change content need not be executed, resulting in convenience. In this case, when a front portion of the bar is designated, a front edge (key-on timing) is moved according to the movement of the cursor. That is, this operation resembles an operation when a person moves an article, and hence, an operation is easy.

DETAILED DESCRIPTION OF THE PREFERRED EMBODIMENT

An embodiment of the present invention will now be described hereinafter.

DESCRIPTION OF ARRANGEMENT OF EMBODIMENT

Figure 1:
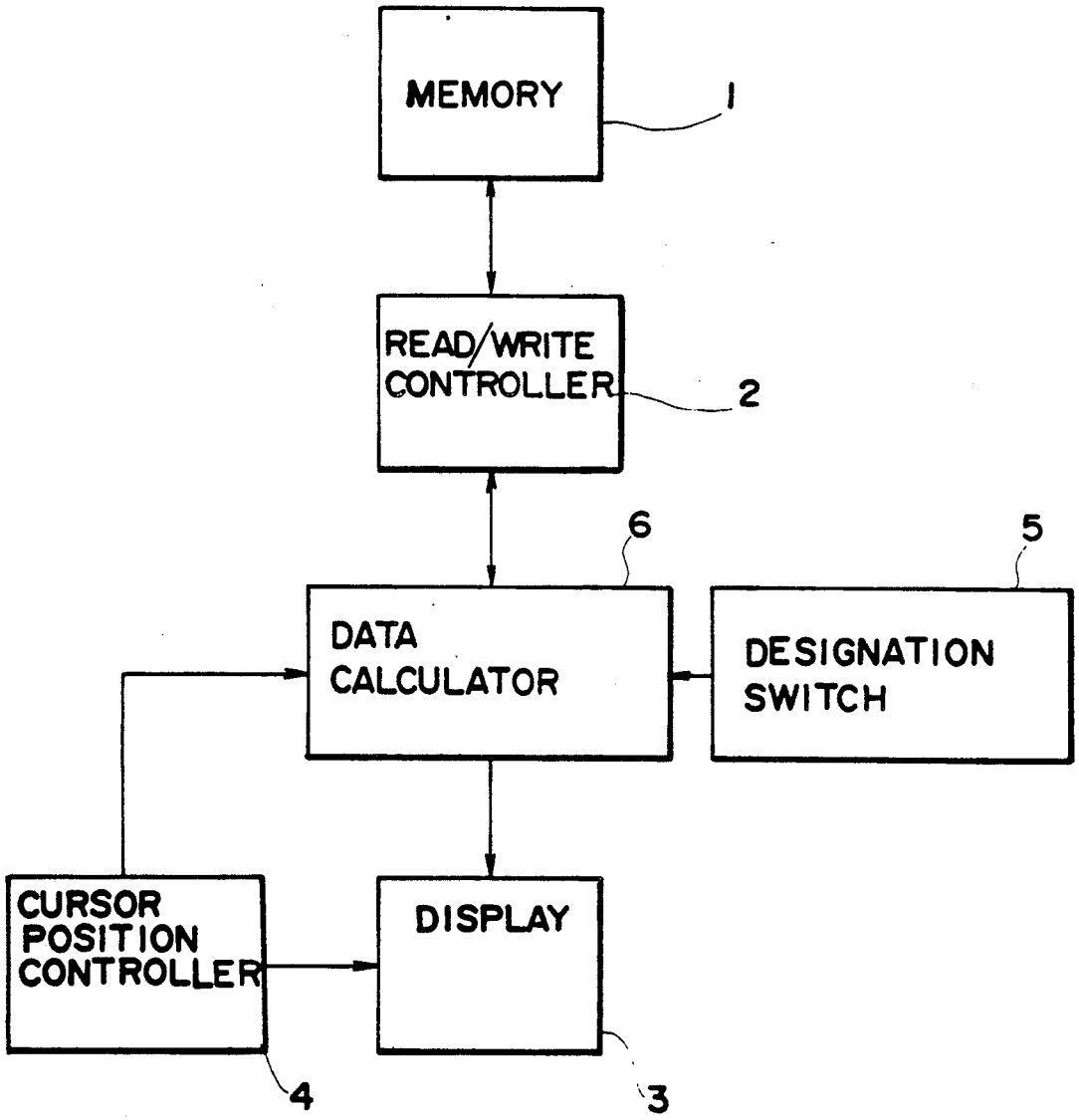
FIG. 1 is a block diagram corresponding to the appended claims.
Figure 2:
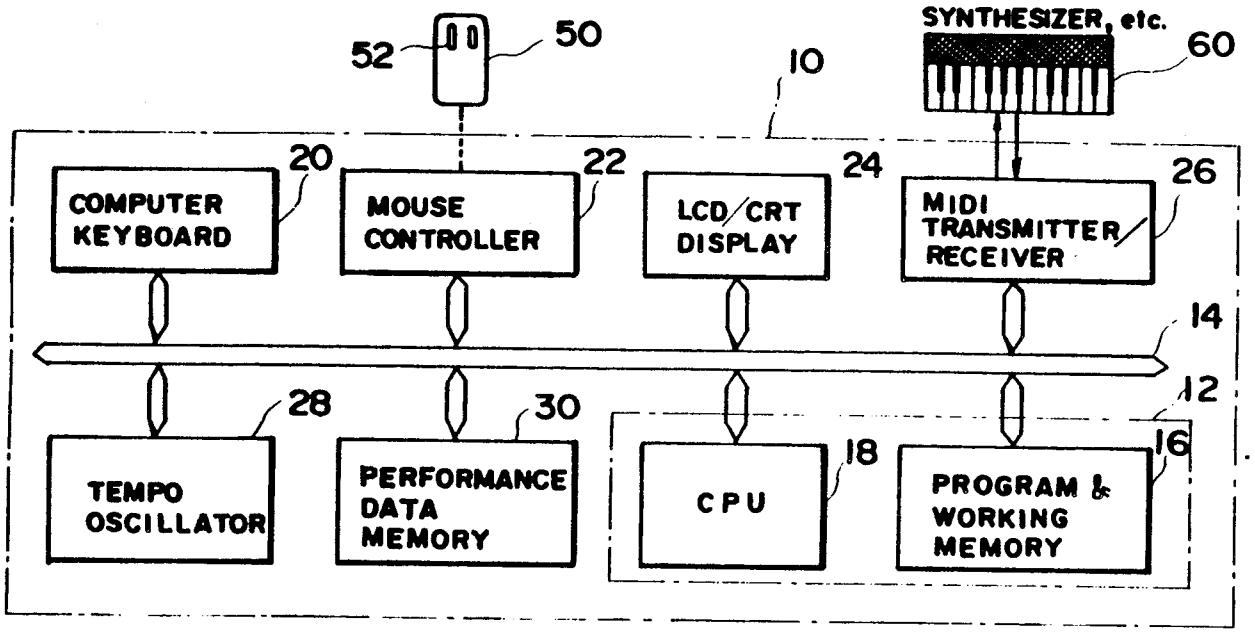
FIG. 2 is a block diagram showing an automatic performance apparatus according to an embodiment of the present invention.

FIG. 2 is a block diagram of an automatic performance apparatus according to an embodiment of the present invention. Reference numeral 10 denotes an apparatus called an MIDI recorder complying with the MIDI (Musical Instrument Digital Interface) standards, which can communicate performance data with another machine 60 complying with the MIDI standards, e.g., a synthesizer.

An operation of the overall automatic performance apparatus 10 is controlled by a microcomputer 12. The microcomputer 12 comprises a program & working memory 16 and a CPU 18 which are connected to a bus 14. The bus 14 is also connected to a computer keyboard 20, a mouse controller 22, a display 24, an MIDI transmitter/receiver 26, a tempo oscillator 28, and a performance data memory 30. The mouse controller 22 is connected to a mouse 50 having a left button 52.

A program area and a working area are allocated in the program & working memory 16. The program area comprises a ROM, and stores a main program corresponding to the flow chart shown in FIG. 5 and subprograms, e.g., note length change, note creation, note erase, performance start, performance end, recording start, recording end subprograms, and the like. The working area comprises a RAM, and temporarily stores various data generated when the CPU 18 executes the above programs. The working area includes the following registers. In the following description, the registers and their contents (data) are indicated by identical labels.

Note gate NOTEGATE
gate time (note length) of selected note
Note key code NOTEKC
key code (pitch) of selected note
Note time NOTETIME
tone generation timing (key-on timing) of selected note
Address pointers $P_1$ and $P_2$
pointer registers for designating addresses of the performance data memory 30; the pointer $P_2$ serves as a pointer register as a temporary memory The CPU 18 starts execution of the main program upon power-on of a power switch (not shown), and repetitively executes the program until the power switch is turned off.

The computer keyboard 20 is used for setting operation modes of the microcomputer 12 and inputting various data.

The mouse controller 22 detects a moving amount of the mouse 50 in X and Y directions, and outputs displacement data in the X and Y directions. The controller 22 detects a depression of the left button 52 of the mouse 50, and outputs a detection signal.

Figure 4:
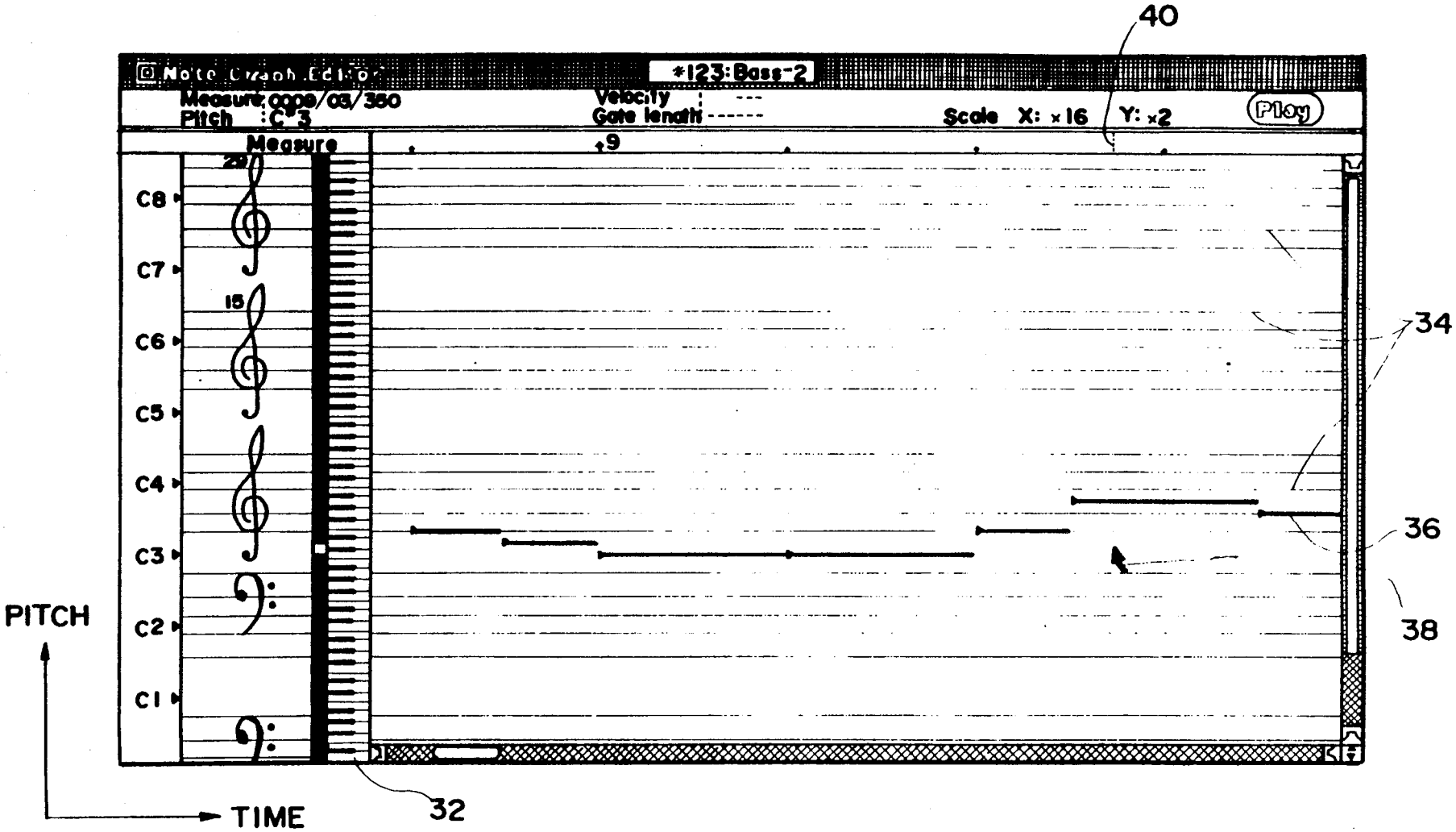
FIG. 4 shows a display screen of a display shown in FIG. 2.

The display 24 is a display device using an LCD (liquid-crystal display) or a CRT (cathode-ray tube), and on its display screen, a pitch is plotted along a Y axis (ordinate) and a time is plotted along an X axis (abscissa), as shown in FIG. 4. On the display screen, a graphic pattern 32 of a keyboard is displayed in the vertical direction, and a staff 34 as a measure of a pitch is displayed so that a position of each key of the keyboard pattern 32 corresponds to a pitch of a note displayed on the staff 34. On the display screen, notes corresponding to some of performance data (for five times) are displayed in the form of bars 36 each having a length in the X direction corresponding to a note length. A cursor position display line 40 for allowing easy understanding of a cursor 38 and a time position of the cursor is also displayed on the display screen.

The MIDI transmitter/receiver 26 is an interface for transmitting/receiving performance data with the externally connected MIDI machine 60.

The tempo oscillator 28 is used for designating a tempo of an automatic performance in an automatic performance (play) mode. The oscillator 28 comprises a fixed-frequency oscillator and a frequency divider with a variable frequency division ratio. When the frequency division ratio is set in accordance with a tempo designated by the performance or a key input at the computer keyboard 20, the oscillator 28 generates a tempo clock having a period according to the designated tempo.

Figure 3:
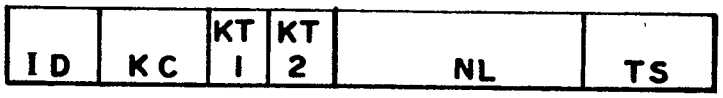
FIG. 3 shows a format of various performance data stored in a performance data memory shown in FIG. 2.

The performance data memory 30 comprises a RAM, and has a large number of storage positions $APM(P_1)$ addressed by an address $P_1$ set in the address register $P_1$ in the program & working memory 16. The following various performance data are stored at the storage positions $APM(P_1)$ in a data format shown in FIG. 3.

Note data

Note data consists of an identification mark ID indicating note data, a key code KC indicating a pitch, key touch data KT, note length data NL, and accidental data TS. The key touch data KT indicates a key-on event KT1 or a key-off event KT2 and a key touch at that time. The accidental data TS includes flat (♭), sharp (#), double sharp (##), and the like.

Step time data

Step time data consists of an identification mark ID indicating step time data, and step time data STP. The step time data STP represents a time interval between a key-on timing of a given note and that of the next note.

End data

End data is data indicating an end of performance, and consists of only identification data ID indicating the end data.

DESCRIPTION OF OPERATION OF EMBODIMENT

The operation of the embodiment with the above arrangement will be described below with reference to the flow charts of FIGS. 5 and 6.

1. Main Processing

Figure 5:
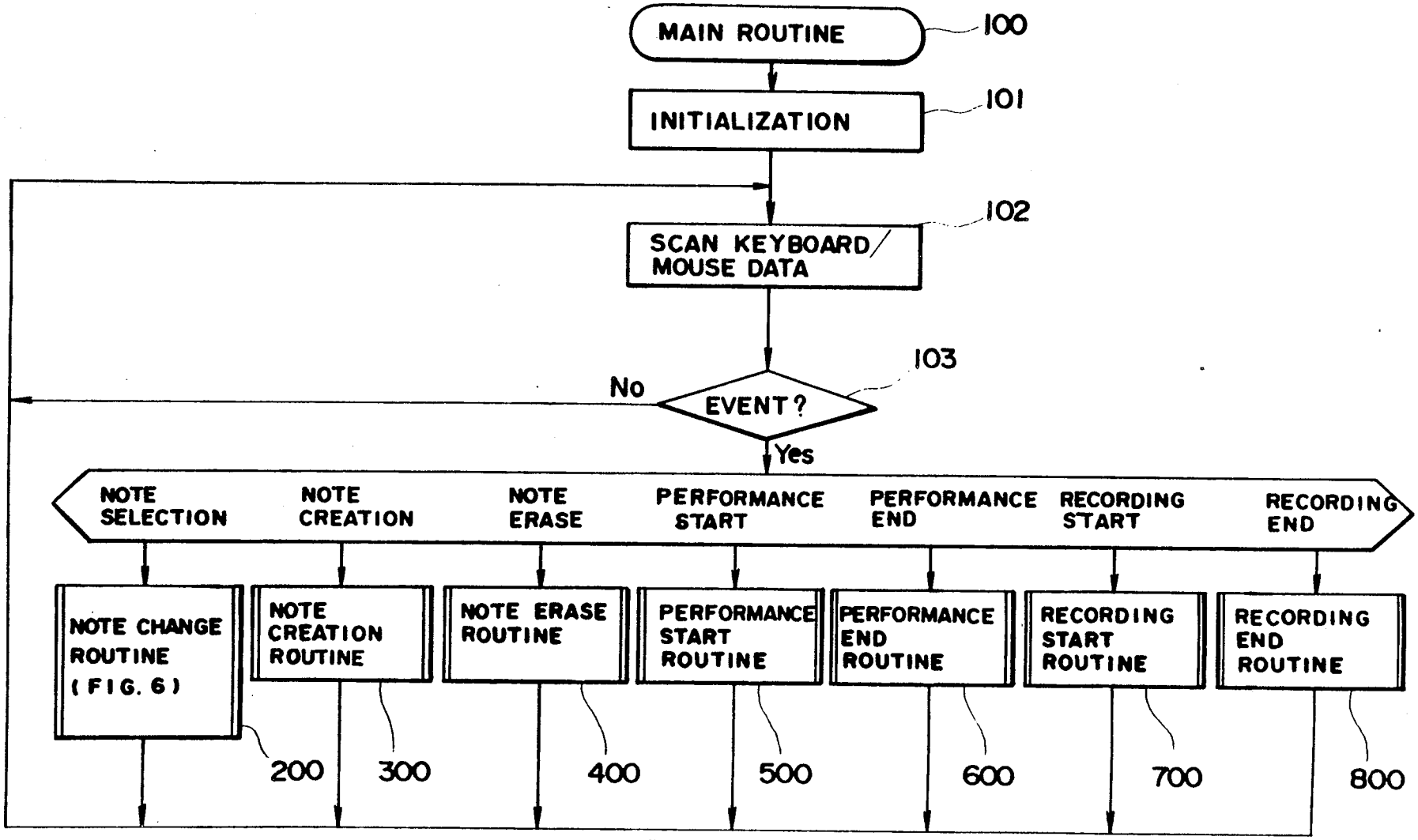
FIGS. 5 and 6 are flow charts corresponding to an example of a program executed by a microcomputer of the automatic performance apparatus shown in FIG. 2.

When the power switch (not shown) is turned on in the automatic performance apparatus 10, the CPU 18 starts execution of the main program in step 100 in FIG. 5, and clears the registers and flags in the program & working memory 16 to initialize the microcomputer 12 in step 101. After the initialization, the CPU 18 accesses the computer keyboard 20 and the mouse controller 22 in step 102, and detects the presence/absence of an event at the keyboard 20 and the mouse 50 in step 103. If no event occurs at the keyboard 20 and the mouse 50, the CPU 18 determines "NO" in step 103, i.e., determines that there is no event, and repetitively executes loop processing consisting of steps 102 and 103 until an event occurs.

If "YES" in step 103, i.e., it is determined that an event has occurred, the CPU 18 checks the content of the event, and causes the program to advance to a subroutine corresponding to the event.

More specifically, when the left button (click) 52 of the mouse 50 is depressed, the CPU 18 causes the program to advance to a note change subroutine in step 200. When one of note creation, note erase, performance start, performance end, recording start and recording end instructions is key-input at the keyboard 20, the CPU 18 causes the program to advance to processing of one of six subroutines, i.e., the note creation subroutine in step 300 to the recording end subroutine in step 800 in accordance with the key-input instruction.

Note that the operations in six subroutines, i.e., the note creation subroutine in step 300 to the recording end subroutine in step 800 are the same as those of a conventional editor of the same type (e.g., U.S. Pat. No. 4,646,609 and U.S. patent application Ser. No. 07/210,926).

For example, the note creation subroutine in step 300 is equivalent to "Usual Sound Sub-Routine" shown in FIG. 5 in the U.S. patent application Ser. No. 07/210,926. The note erase subroutine in step 400 is equivalent to "DELETE KEY" subroutine shown in FIG. 12 in the U.S. Pat. No. 4,646,609, and functions so as to erase an indicated note.

The performance start subroutine in step 500 is equivalent to a subroutine comprising steps 605, 606, and 1200 (step 1200 being shown in FIG. 11 in detail) in FIG. 4 in the U.S. patent application Ser. No. 07/210,926.

The performance end subroutine in step 600 is equivalent to step 1000 (shown in FIG. 8 in detail) in FIG. 4 in the U.S. patent application Ser. No. 07/210,926.

The recording start subroutine in step 700 is equivalent to a subroutine comprising steps 606 and 1100 (step 1100 being shown in FIG. 9 in detail) in FIG. 4 in the U.S. patent application Ser. No. 07/210,926.

The recording end subroutine in step 800 corresponds to step 1000 (FIG. 8) in the U.S. patent application Ser. No. 07/210,926.

2. Note Change Processing

During the loop processing consisting of steps 102 and 103 in FIG. 5, when the left button (click) 52 of the mouse 50 is depressed (dragged), the CPU 18 determines "YES" in step 103, i.e., that an event has occurred. Since the content of the event is "depression of the left button (click) 52 of the mouse 50", the CPU 18 causes the program to advance to step 200, and executes the note change processing shown in detail in FIG. 6 in step 200.

Figure 6:
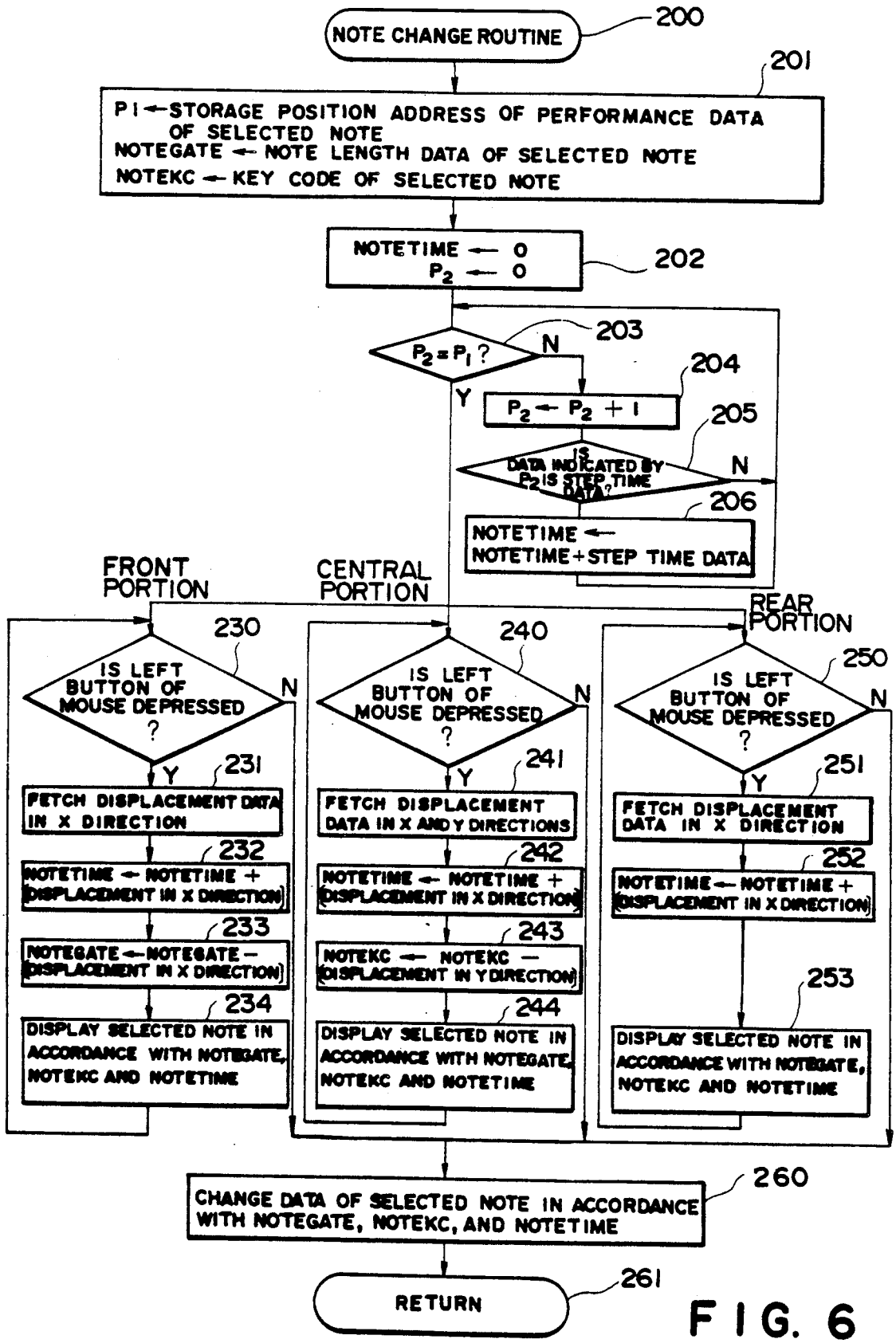

In the note change processing in FIG. 6, its execution is started in step 200. In step 201, a storage position address in the performance data memory 30 of performance data of a note indicated by the cursor 38 and selected by the left button 52, and note length data NL and key code data KC of the selected note are respectively stored in the address pointer $P_1$, the note gate register NOTEGATE, and the note code register NOTEKC allocated in the program & working memory 16. In step 202, the note time register NOTETIME and the temporary memory pointer $P_2$ in the memory 16 are cleared. Thereafter, it is checked in step 203 if the content $P_2$ of the temporary memory pointer $P_2$ is equal to the content $P_1$ of the address pointer $P_1$.

If it is determined in step 203 that $P_2 \neq P_1$, the program advances to step 204. Thereafter, in loop processing of steps 203 to 206, a key-on timing NOTETIME of the selected note is calculated. More specifically, the pointer $P_2$ is incremented by one in step 204, and it is then checked in step 205 if data stored at the storage position $APM(P_2)$ of the performance data memory 30 is note interval (or step time STP) data. If "NO" in step 205, the flow returns to step 203; otherwise, the step time data is added to the content of the note time register NOTETIME in step 206, and the flow then returns to step 203. The processing in steps 204 to 206 is repetitively executed until "YES" is determined in step 203, so that an accumulation value of the step time data from the first performance data to the selected note, i.e., the key-on timing NOTETIME is calculated.

When the pointer $P_2$ is sequentially incremented to satisfy $P_2 = P_1$, and "YES" is determined in step 203, the CPU 18 causes the program to advance to step 210. In step 210, a portion of the bar 36 representing the note designated by the cursor 38 when the left button 52 of the mouse 50 is depressed and the note is selected is detected If it is determined in step 210 that the front portion of the bar 36 is designated, the CPU 18 causes the program to advance to step 230; if the central portion of the bar is designated, step 240; and if the rear portion is designated, step 250.

It is checked in step 230 if the left button 52 of the mouse 50 is depressed. The first checking result is "YES", and the program advances to step 231. The CPU 18 accesses the mouse controller 22 to fetch a displacement in the X direction in step 231, and adds the displacement in the X direction to the note time NOTETIME in step 232. The CPU 18 subtracts the displacement in the X direction from the note gate NOTEGATE in step 233, and supplies the note gate NOTEGATE, note key code NOTEKC, and note time NOTETIME to the display 24 in step 234. The display 24 displays the selected note in accordance with these data. Thereafter, the CPU 18 causes the program to return to step 230 to check if the left button 52 of the mouse 50 is depressed yet. The processing in steps 230 to 234 is repeated until the left button 52 of the mouse 50 is released. Thus, the display 24 displays such that the key-on timing and note length of the selected note, i.e., the distal end (left end portion) of the bar representing the note is changed in the X direction simultaneously with the movement of the cursor 38 in accordance with the movement of the mouse 50.

When the left button 52 of the mouse 50 is depressed in a state wherein the cursor 38 indicates the central portion of the bar, the CPU 18 causes the program to advance to step 240, after detection in step 210, to check if the left button 52 of the mouse 50 is depressed. The first checking result is "YES", and the CPU 18 advances the program to step 241. The CPU 18 accesses the mouse controller 22 to fetch the displacement data in the X and Y directions in step 241, and adds the displacement in the X direction to the note time NOTETIME in step 242. The CPU 18 subtracts the displacement in the Y direction from the note key code NOTEKC in step 243, and supplies the note gate NOTEGATE, note key code NOTEKC, and note time NOTETIME to the display 24 in step 244. The display 24 displays the selected note in accordance with these data. Thereafter, the CPU 18 causes the program to return to step 240 to check if the left button 52 of the mouse 50 is depressed yet. The processing in steps 240 to 244 is repeated until the left button 52 of the mouse 50 is released. Thus, the pitch, key-on timing, and key-off timing of the selected note are changed while its note length is left unchanged. More specifically, on the screen of the display 24, the entire bar 36 representing the selected note is moved parallel in the X and Y directions simultaneously with the movement of the cursor in accordance with the movement of the cursor.

When the left button 52 of the mouse 50 is depressed while the cursor indicates the rear portion of the bar 36 representing the selected note, the CPU 18 causes the program to advance to step 250, after determination of step 210, to check if the left button 52 of the mouse 50 is depressed. The first checking result is "YES", and the program advances to step 251. The CPU 18 accesses the mouse controller 22 to fetch a displacement in the X direction in step 251, and adds the displacement in the X direction to the note gate NOTEGATE in step 252. In step 254, the CPU 18 supplies the note gate NOTEGATE, note key code NOTEKC, and note time NOTETIME to the display 24. The display 24 displays the selected note in accordance with these data. Thereafter, the CPU 18 causes the program to return to step 250 to check if the left button 52 of the mouse 50 is depressed yet. The processing in steps 250 to 254 is repeated until the left button 52 of the mouse 50 is released. Thus, the note length of the selected note is changed while its key-on timing and pitch are left unchanged. That is, on the display screen, the rear end (right end portion) of the bar representing the note is extended/contracted in the X direction upon movement of the cursor.

During execution of the processing in steps 230 to 234, steps 240 to 244, or steps 250 to 254, when the left button 52 of the mouse 50 is released, the CPU 18 determines "NO" in step 230, 240, or 250, and causes the program to advance to step 260. In step 260, the CPU 18 rewrites data associated with the selected note in the performance data memory 30 with latest (changed) data as the contents of the note gate register NOTEGATE, note key code register NOTEKC, and note time register NOTETIME, and also rewrites NOTETIME associated with other notes influenced by the former rewrite operation. The program then returns to the main processing (step 101 in FIG. 5) in step 261.

Figure 7C:
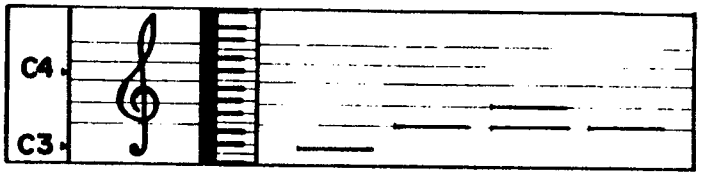
FIGS. 7A to 7C are views showing a correspondence among a music score, performance data, and a display screen in the automatic performance apparatus shown in FIG. 2.
Figure 7B:
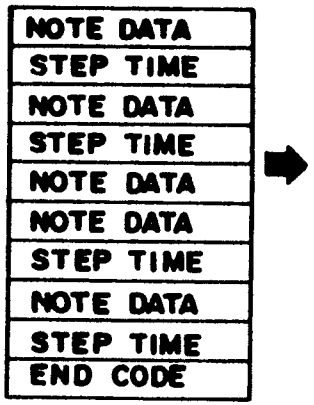
Figure 7A:
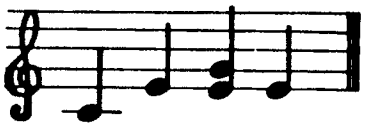
Figure 8:
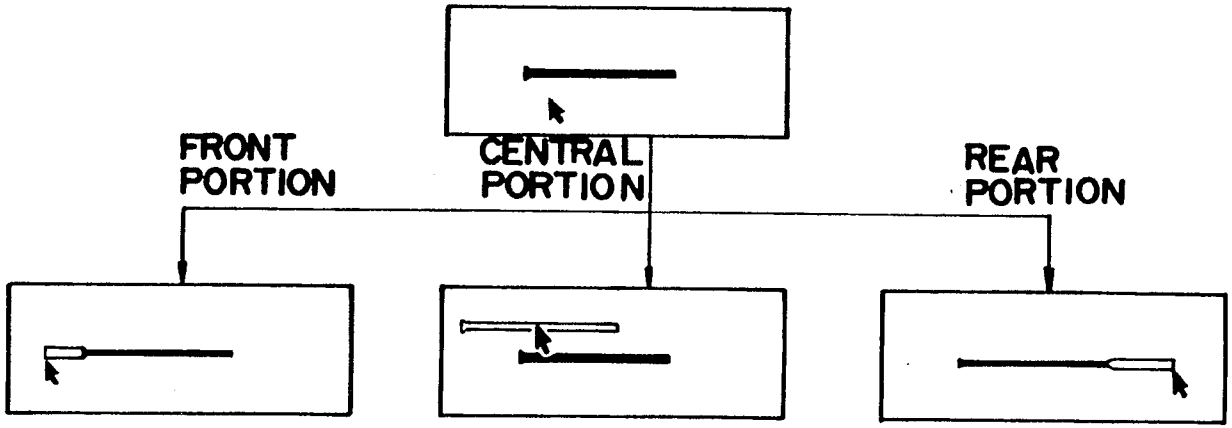
FIG. 8 is a view showing the relationship between a mouse operation and a state of a change in displayed note in the automatic performance apparatus shown in FIG. 2.

FIGS. 7A to 7C show the relationship among a music score (FIG. 7A), performance data (FIG. 7B), and the display screen (FIG. 7C), and FIG. 8 shows a change in bar representing the selected note upon subsequent cursor movement in accordance with a cursor position when this note is selected in correspondence with the flow chart in FIG. 6.

According to this embodiment, each note can be finely changed as if an end of a bar representing a note were held with a cursor and were moved to the left or right. Therefore, a special and delicate edit operation can be performed such that notes are played like a legato performance technique, or key-on or key-off timings of a plurality of notes having a period wherein they are simultaneously keyed on are offset from each other.

APPLICATION RANGE OF THE PRESENT INVENTION

Note that the present invention is not limited to the above embodiment, and various changes and modifications may be made within the spirit and scope of the invention. For example, in the above embodiment, a note is displayed in the form of a bar. However, a note may be displayed in the form of a "tadpole" like in the conventional apparatus. In this case, an edit operation can be performed with the "tadpole" display. However, when a note is designated by a cursor and is selected in the edit mode, the corresponding note can be changed in the bar indication. This is preferable since the change content can be designated by the cursor position simultaneously with note designation.

The shape of the note may be discontinuously changed like a quarter note, eighth note, sixteenth note, . . . , and when a note is displayed in the form of a bar, the length of the bar may be continuously changed.

In the above embodiment, an operation instruction other than the note change instruction is key-input at the computer keyboard 20. A plurality of operation instructions can be displayed on the screen, so that a desired one of the displayed operation instructions can be indicated by a cursor and can be selected by depressing the button (drag or click switch) of the mouse, as needed.

In the above embodiment, the cursor position is controlled by the mouse, and note designation is performed by the button of the mouse. Alternatively, cursor position control may be performed by a joystick or cursor keys and note designation may be performed by a specific key on the keyboard, e.g., an enter key.

What is claimed is:

1. An automatic performance apparatus for performing a automatic performance in accordance with musical performance data, comprising:

memory means for storing the musical performance data for controlling generation of musical tones in accordance with a progress of a music piece;

read/write control means for storing input data in said memory means and reading out and outputting the performance data stored in said memory means;

display means for displaying a staff, a cursor, and at least one note character whose shape changes correspondingly with a note length designated by said input data;

cursor position control means for controlling a cursor position;

note designating means for designating a note character displayed on said display means in correspondence with the cursor position; and data calculating means for calculating at least one of pitch, key-on timing, key-off timing, note interval and note length data associated with a designated note character on the basis of the musical performance data read out from said memory means and a moving direction and amount of the cursor and supplying the calculated data to said read/write control means and said display means, wherein at least one of a position and shape of a note character displayed on said display means is changed in real time in accordance with movement of the cursor.

2. An apparatus according to claim 1, wherein said note character is a bar having a lateral length corresponding to the note length thereof on the staff wherein a pitch is plotted along an ordinate and a time is plotted along an abscissa, and said data calculating means, when the cursor is located at the front portion of the bar upon designation of the note character by said designating means, calculates the key-on timing data of the note associated with the designated note character in accordance with the moving direction and amount of the cursor after designation and, when the cursor is located at the rear portion of the bar upon designation of the note character, calculates the key-off timing data or note length data of the note associated with the designated note character.

3. An automatic performance apparatus for performing an automatic performance in accordance with musical performance data, comprising:

memory means for storing the musical performance data for controlling generation of musical tones in accordance with a process of a music piece;

read/write control means for storing input data in said memory means and reading out and outputting the performance data stored in said memory means;

display means for displaying a staff, a cursor, and at least one note character whose shape changes correspondingly with a note length designated by said input data;

cursor position control means for controlling a cursor position;

note designating means for designating a note character displayed on said display means in correspondence with the cursor position; and data calculating means for calculating at least one of pitch, key-on timing, key-off timing, note interval and note length data associated with a designated note character on the basis of the musical performance data read out from said memory means and a moving direction and amount of the cursor and supplying the calculated data to said read/write control means and said display means, wherein at least one of a position and shape of a note character displayed on said display means is changed in real time in accordance with movement of the cursor;

wherein said note character is a bar having a lateral length corresponding to the note length thereof on the staff wherein a pitch is plotted along an ordinate and a time is plotted along an abscissa, and when the cursor is located at the central portion of the bar upon designation of the note character by said designating means, said data calculating means calculates the pitch and key-on timing data of the note associated with the designated note character in accordance with the moving direction and amount of the cursor after designation without changing the note length data.

4. An automatic performance apparatus for performing an automatic performance in accordance with musical performance data, comprising:

memory means for storing the musical performance data for controlling generation of musical tones in accordance with a progress of a musical piece;

display means for displaying a cursor and note characters, each of the note characters having a shape corresponding to a note length of said musical performance data;

modifying means for modifying the shape of said note characters on said display means with said cursor;

detecting means for detecting a modified amount of the shape of said note characters and for generating an editing signal representing said modified amount; and editing means for editing said note length of said musical performance data in accordance with said editing signal so that said automatic performance can be performed based on the musical performance data modified through said display means.

5. An apparatus according to claim 4, wherein each note character is a bar having a lateral length corresponding to the note length of the associated note on a staff wherein a pitch is plotted along an ordinate and a time is plotted along an abscissa, and said modifying means, when the cursor designates at the front portion of the bar and moves therefrom, calculates the key-on timing data of the associated note in accordance with the moving direction and amount of the cursor and, when the cursor designates at the rear portion of the bar and moves therefrom, calculates the key-off timing data or note length data of the associated note.

6. An automatic performance apparatus for performing an automatic performance in accordance with musical performance data, comprising:

memory means for storing the musical performance data for controlling generation of musical tones in accordance with a progress of a musical piece;

display means for displaying a cursor and note characters, each of the note characters having a shape corresponding to a note length of said musical performance data;

modifying means for modifying the shape of said note characters on said display means with said cursor;

detecting means for detecting a modified amount of the shape of said note characters and for generating an editing signal representing said modified amount; and editing means for editing said note length of said musical performance data in accordance with said editing signal so that said automatic performance can be performed based on the musical performance data modified through said display means;

wherein each note character is a bar having a lateral length corresponding to the note length of the associated note on a staff wherein a pitch is plotted along an ordinate and a time is plotted along an abscissa, and when the cursor designates at the central portion of the bar and moves therefrom, said data of the associated note in accordance with the moving direction and amount of the cursor after designation without changing the note length data.

7. An automatic performance apparatus for performing an automatic performance in accordance with musical performance data, comprising:

a memory which stores the musical performance data for controlling generation of musical tones in accordance with a progress of a musical piece;

a display which displays a cursor and note characters, each of the note characters having a shape corresponding to a note length of said musical performance data;

a designator operable to designate a position of each of said note characters on said display with said cursor;

a detector which detects an amount of change of said position and generates an editing signal representing a detected amount; and an editor operable to modify said musical performance data in accordance with said editing signal so that said automatic performance can be performed based on the musical performance data modified through said display.

* * * * *